US011158269B2

(12) United States Patent
Ahn et al.

(10) Patent No.: US 11,158,269 B2
(45) Date of Patent: Oct. 26, 2021

(54) DISPLAY DEVICE AND METHOD OF DRIVING THE SAME

(71) Applicant: Samsung Display Co., Ltd., Yongin-si (KR)

(72) Inventors: Gwangsoo Ahn, Suwon-si (KR); Kihyun Pyun, Gwangmyeong-si (KR); Moonshik Kang, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/582,454

(22) Filed: Sep. 25, 2019

(65) Prior Publication Data

US 2020/0160796 A1 May 21, 2020

(30) Foreign Application Priority Data

Nov. 19, 2018 (KR) ..... 10-2018-0142245

(51) Int. Cl.
*G09G 3/34* (2006.01)

(52) U.S. Cl.
CPC ..... *G09G 3/342* (2013.01); *G09G 2310/0243* (2013.01); *G09G 2310/08* (2013.01); *G09G 2320/0686* (2013.01); *G09G 2370/00* (2013.01)

(58) Field of Classification Search
CPC ..... G09G 3/342; G09G 2320/0686; G09G 2310/0243; G09G 2370/00; G09G 2310/08; G09G 3/3406; G09G 3/3413
See application file for complete search history.

(56) References Cited

U.S. PATENT DOCUMENTS

2005/0140597 A1* 6/2005 Lee ..... G09G 3/3233 345/76
2006/0012543 A1* 1/2006 Ikeda ..... G09G 3/3648 345/36
2015/0116379 A1* 4/2015 Lim ..... G02F 1/133603 345/691
2016/0203774 A1* 7/2016 Ahn ..... G09G 3/3426 345/102
2017/0094818 A1* 3/2017 Kim ..... H05K 1/11
2017/0236472 A1* 8/2017 Yonemaru ..... H05B 45/37 345/690

FOREIGN PATENT DOCUMENTS

KR 10-1451254 B1 10/2014

* cited by examiner

*Primary Examiner* — Mark W Regn
(74) *Attorney, Agent, or Firm* — Lewis Roca Rothgerber Christie LLP

(57) ABSTRACT

A display device includes a light-source module including a plurality of light-source blocks configured to provide light to a display panel, a plurality of light-source drivers configured to drive the plurality of light-source blocks, a timing controller configured to generate a dimming level signal of a corresponding one of the light-source blocks, and to generate a dimming select signal configured to select a corresponding one of the light-source drivers corresponding to the dimming level signal, a signal converter configured to convert an n-bit dimming select signal into an m-bit switch control signal, "n" and "m" being natural numbers, and n being less than m, and a plurality of switches connected between the timing controller and the plurality of light-source drivers, and configured to provide a plurality of dimming level signals to the plurality of light-source drivers based on a switch control signal.

18 Claims, 9 Drawing Sheets

FIG. 3

| | DSS (4bit) | | | | DCS (16bit) | | | | | | | SWC (16bit) | | | | | | |
|---|---|---|---|---|---|---|---|---|---|---|---|---|---|---|---|---|---|---|
| | C1 | C2 | C3 | C4 | A1 | A2 | A3 | ~ | A15 | A15 | A16 | B1 | B2 | B3 | ~ | B15 | B15 | B16 |
| 1 | 0 | 0 | 0 | 0 | 0 | 0 | 0 | ~ | 0 | 0 | 1 | 0 | 0 | 0 | ~ | 0 | 0 | 1 |
| 2 | 0 | 0 | 0 | 1 | 0 | 0 | 0 | ~ | 0 | 1 | 1 | 0 | 0 | 0 | ~ | 0 | 1 | 0 |
| 3 | 0 | 0 | 1 | 0 | 0 | 0 | 0 | ~ | 1 | 1 | 1 | 0 | 0 | 0 | ~ | 1 | 0 | 0 |
| 4 | 0 | 0 | 1 | 1 | 0 | 0 | 0 | ~ | 1 | 1 | 1 | 0 | 0 | 0 | ~ | 0 | 0 | 0 |
| 5 | 0 | 1 | 0 | 0 | 0 | 0 | 0 | ~ | 1 | 1 | 1 | 0 | 0 | 0 | ~ | 0 | 0 | 0 |
| 6 | 0 | 1 | 0 | 1 | 0 | 0 | 0 | ~ | 1 | 1 | 1 | 0 | 0 | 0 | ~ | 0 | 0 | 0 |
| 7 | 0 | 1 | 1 | 0 | 0 | 0 | 0 | ~ | 1 | 1 | 1 | 0 | 0 | 0 | ~ | 0 | 0 | 0 |
| 8 | 0 | 1 | 1 | 1 | 0 | 0 | 0 | ~ | 1 | 1 | 1 | 0 | 0 | 0 | ~ | 0 | 0 | 0 |
| 9 | 1 | 0 | 0 | 0 | 0 | 0 | 0 | ~ | 1 | 1 | 1 | 0 | 0 | 0 | ~ | 0 | 0 | 0 |
| 10 | 1 | 0 | 0 | 1 | 0 | 0 | 0 | ~ | 1 | 1 | 1 | 0 | 0 | 0 | ~ | 0 | 0 | 0 |
| 11 | 1 | 0 | 1 | 0 | 0 | 0 | 0 | ~ | 1 | 1 | 1 | 0 | 0 | 0 | ~ | 0 | 0 | 0 |
| 12 | 1 | 0 | 1 | 1 | 0 | 0 | 0 | ~ | 1 | 1 | 1 | 0 | 0 | 0 | ~ | 0 | 0 | 0 |
| 13 | 1 | 1 | 0 | 0 | 0 | 0 | 0 | ~ | 1 | 1 | 1 | 0 | 0 | 0 | ~ | 0 | 0 | 0 |
| 14 | 1 | 1 | 0 | 1 | 0 | 0 | 1 | ~ | 1 | 1 | 1 | 0 | 0 | 1 | ~ | 0 | 0 | 0 |
| 15 | 1 | 1 | 1 | 0 | 0 | 1 | 1 | ~ | 1 | 1 | 1 | 0 | 1 | 0 | ~ | 0 | 0 | 0 |
| 16 | 1 | 1 | 1 | 1 | 1 | 1 | 1 | ~ | 1 | 1 | 1 | 1 | 0 | 0 | ~ | 0 | 0 | 0 |

DISPLAY DEVICE AND METHOD OF DRIVING THE SAME

CROSS-REFERENCE TO RELATED APPLICATION

This application claims priority to, and the benefit of, Korean Patent Application No. 10-2018-0142245 filed on Nov. 19, 2018, which is hereby incorporated by reference for all purposes as if fully set forth herein.

BACKGROUND

1. Field

Embodiments of the present disclosure relate to a display device, and a method of driving the display device.

2. Description of the Related Art

Generally, a display device includes a display panel for displaying an image by using light transmittance of a liquid crystal, and a backlight assembly located under the display panel to provide a light to the display panel.

The display panel includes an array substrate having a thin film transistor electrically connected to pixel electrodes, the pixel electrodes, a color filter substrate having color filters and a common electrode, and a liquid crystal layer between the array substrate and the color filter substrate.

An arrangement of the liquid crystal layer is changed by an electric field formed between the pixel electrodes and the common electrode, thereby changing the transmittance of light passing through the liquid crystal layer. When the transmittance of the light increases (e.g., to a maximum), the display panel can realize a white image with high luminance. On the other hand, when the transmittance of the light is reduced (e.g., to a minimum), the display panel may implement a black image with low luminance.

The backlight assembly includes a plurality of light-source blocks, and the plurality of light-source blocks operate according to the local-dimming method. The local-dimming method controls the amount of the light per the light-source block according to the gradation of the image displayed on the display panel.

SUMMARY

Embodiments of the present disclosure provide a display device for reducing a number of output pins corresponding to control signals, and provide a method of driving the display device.

According to an embodiment of the present disclosure, there is provided a display device including a light-source module including a plurality of light-source blocks configured to provide light to a display panel, a plurality of light-source drivers configured to drive the plurality of light-source blocks, a timing controller configured to generate a dimming level signal of a corresponding one of the light-source blocks, and to generate a dimming select signal configured to select a corresponding one of the light-source drivers corresponding to the dimming level signal, a signal converter configured to convert an n-bit dimming select signal into an m-bit switch control signal, "n" and "m" being natural numbers, and n being less than m, and a plurality of switches connected between the timing controller and the plurality of light-source drivers, and configured to provide a plurality of dimming level signals to the plurality of light-source drivers based on a switch control signal.

The signal converter may include a decoder configured to convert an n-bit dimming select signal into an m-bit decoded signal, and an operator configured to perform a logical operation on the m-bit decoded signal, and to generate an m-bit switch control signal.

The m-bit decoded signal of the switch control signal may be applied to a control terminal of each of the plurality of switches.

The operator may include a plurality of AND-gates respectively connected to the plurality of switches, wherein a k-th AND-gate among the plurality of AND-gates includes a first input terminal for receiving a k-th bit signal of the m-bit decoded signal, a second input terminal for receiving and inverting a (k−1)-th bit signal of the m-bit decoded signal, and an output terminal connected to a control terminal of a k-th switch among the plurality of switches, "k" being a natural number.

A second input terminal of a first AND-gate among the plurality of AND-gates may be configured to receive and invert a ground signal.

The timing controller may be configured to transmit the plurality of dimming level signals to the plurality of light-source drivers through a serial peripheral interface.

The display device may further include a first printed circuit board on which the light-source blocks are mounted, a second printed circuit board on which the timing controller is mounted, and a third printed circuit board on which the plurality of switches, the decoder, and the operator are mounted.

The display device may further include a first printed circuit board on which the light-source blocks are mounted, and a second printed circuit board on which the timing controller, the plurality of switches, the decoder, and the operator are mounted.

According to an embodiment of the present disclosure, there is provided a method of driving the display device that includes a light-source module including a plurality of light-source blocks configured to provide light to a display panel, and a plurality of light-source drivers configured to drive the plurality of light-source blocks, the method including outputting a dimming select signal to select one of the light-source drivers corresponding to a dimming level signal, and outputting the dimming level signal of a corresponding one of the light-source blocks, converting an n-bit dimming select signal into an m-bit switch control signal, "n" and "m" being natural numbers, and n being less than m, applying the m-bit switch control signal to a plurality of switches connected to the plurality of light-source drivers, respectively, and applying the plurality of dimming level signals to the plurality of light-source drivers based on driving of the plurality of switches.

Converting the n-bit dimming select signal may include converting an n-bit dimming select signal into an m-bit decoded signal, and generating the m-bit switch control signal by performing an AND-operation on the m-bit decoding signal.

The method may further include performing the AND-operation on a k-th bit signal of the m-bit decoded signal, and an inverted signal of which a (k−1)-th bit signal of the m-bit decoded signal is inverted, generating a k-th bit signal of the m-bit switch control signal, and applying the k-th bit signal of the m-bit switch control signal to a control terminal of a k-th switch, "k" being a natural number, and k being greater than 1, and less than or equal to m).

The method may further include generating a first bit signal of the m-bit switch control signal applied to a control terminal of a first switch by performing an AND-operation on the first bit signal and an inverted signal of a ground signal.

The method may further include transmitting the dimming level signal to the corresponding one of the light-source drivers through a serial peripheral interface.

According to an embodiment of the present disclosure, there is provided a display device including a light-source module including a plurality of light-source blocks configured to provide light to a display panel, a plurality of light-source drivers configured to drive the plurality of light-source blocks, a timing controller configured to transmit a dimming level signal of a corresponding one of the light-source blocks, and to transmit a dimming select signal to select a corresponding one of the light-source drivers to which the dimming level signal is applied, as a serial signal, and a serial-to-parallel converter configured to convert the dimming level signal and the dimming select signal transmitted in a serial signal into a parallel signal, and to transmit the parallel signal to the plurality of light-source drivers in parallel.

The timing controller may be configured to transmit the dimming level signal and the dimming select signal to the serial-to-parallel converter as differential signals.

The serial-to-parallel converter may be configured to convert the differential signals into a plurality of single signals, and to transmit the plurality of single signals to the plurality of light-source drivers.

The timing controller may be configured to transmit signals to the serial-to-parallel converter through a high-speed differential signaling interface, and the serial-to-parallel converter is configured to transmit signals to the plurality of light-source drivers through a serial peripheral interface.

According to an embodiment of the present disclosure, there is provided a method of driving the display device that includes a light-source module including a plurality of light-source blocks configured to provide light to a display panel, and a plurality of light-source drivers configured to drive the plurality of light-source blocks, the method including generating a dimming level signal of the light-source block, and a dimming select signal for selecting a light-source driver to which the dimming level signal is applied, transmitting the dimming level signal and the dimming select signal as a serial signal, and transmitting the dimming level signal and the dimming select signal transmitted in the serial signal to the plurality of light-source drivers in parallel.

The method may further include transmitting the dimming level signal and the dimming select signal as differential signals through a differential signal interface.

The method may further include converting the differential signals into a plurality of single signals, and transmitting the plurality of single signals to the plurality of light-source drivers through a serial peripheral interface.

According to embodiments disclosed herein, in the local-dimming mode, manufacturing cost may be reduced and signal quality may be improved by reducing the number of pins of the control signals between the timing controller and the plurality of LED drivers.

BRIEF DESCRIPTION OF THE DRAWINGS

The above and other aspects of the present disclosure will become more apparent by describing in detailed embodiments thereof with reference to the accompanying drawings, in which:

FIG. 3 is a conceptual diagram illustrating input and output signals of a light-source driving controller shown in FIG. 2;

DETAILED DESCRIPTION

Figure 1:
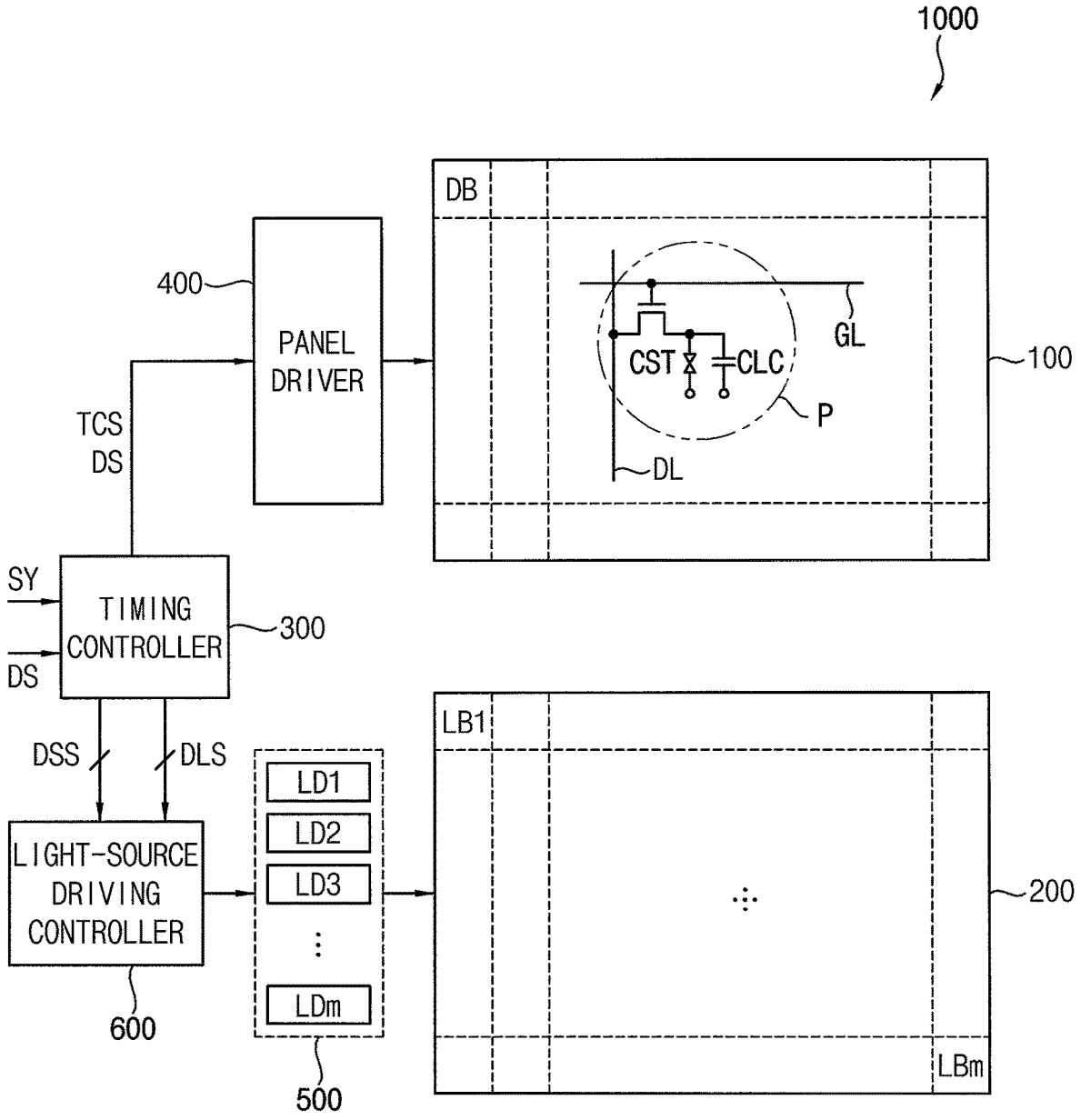
FIG. 1 is a block diagram illustrating a display device according to one embodiment.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to one embodiment.

Referring to FIG. 1, the display device 1000 may include a display panel 100, a light-source module 200, a timing controller 300, a panel driver 400, a light-source driver 500, and a light-source driving controller 600.

The display panel 100 includes a plurality of pixels for displaying an image. Each pixel P includes a pixel switching element TR connected to a gate line GL and a data line DL, a liquid crystal capacitor CLC connected to the pixel switching element TR, and a storage capacitor CST.

The light-source module 200 provides a light to the display panel 100. The light-source module 200 includes a plurality of light-source blocks LB1, LB2, . . . , LBm.

The light-source block includes a light-emitting diode plate on which a light-emitting diode is mounted. The light-source blocks LB1, LB2, . . . , LBm may be arranged in a linear structure. Alternatively, the light-source blocks LB1, LB2, . . . , LBm may be arranged in a matrix structure. The plurality of light-source blocks LB1, LB2, . . . , LBm may be driven individually in a local-dimming mode.

The timing controller 300 receives a synchronous signal SY and an image signal DS (e.g., from an external device). The timing controller 300 generates a timing control signal TCS to control the panel driver 400 using the synchronous signal SY. The timing control signal TCS includes a clock signal, a horizontal synchronous signal, a vertical synchronous signal Vsync, a vertical start signal, and/or a data enable signal.

The timing controller 300 divides the image signal of a frame into a plurality of image blocks DB for the local-dimming mode. The timing controller 300 calculates representative grayscale data of each image block DB. The timing controller 300 generates a plurality of dimming level signals for controlling a luminance of the plurality of light-source blocks LB1, LB2, . . . , LBm using a plurality of representative grayscale data corresponding to the plurality of image blocks DB. The plurality of dimming level signals are signals that are respectively applied to a plurality of LED drivers LD1, LD2, . . . , LDm, which respectively drive the light-source blocks LB1, LB2, . . . , LBm.

The timing controller 300 generates a dimming select signal for selecting the plurality of LED drivers to which the plurality of dimming level signals is applied.

The timing controller 300 provides the dimming select signal DSS and the plurality of dimming level signals DLS to the light-source driving controller 600.

According to one embodiment, a number of output pins of the timing controller 300 for outputting the dimming select signal DSS may be set to a number "n" that is smaller than the number "m" of the plurality of light-source blocks (wherein n<m, and n and m are each a natural number).

The panel driver 400 drives the display panel 100 using the timing control signal TCS and the image signal DS provided from the timing controller 300. For example, the panel driver 400 includes a data driver that generates a data signal using the horizontal synchronous signal, and provides the data line DL with the data signal. The panel driver 400 includes a gate driver that generates a gate signal using the vertical start signal, and provides the gate line GL with the gate signal.

The light-source driver 500 includes a plurality of LED drivers LD1, LD2, LD3, . . . , LDm that individually drive the plurality of light-source blocks LB.

The light-source driving controller 600 provides the plurality of dimming level signals DLS to the plurality of LED drivers LD1, LD2, LD3, . . . , LDm based on the dimming select signal DSS. A detailed description of the light-source driving controller 600 is described with reference to FIGS. 2 and 3.

Figure 2:
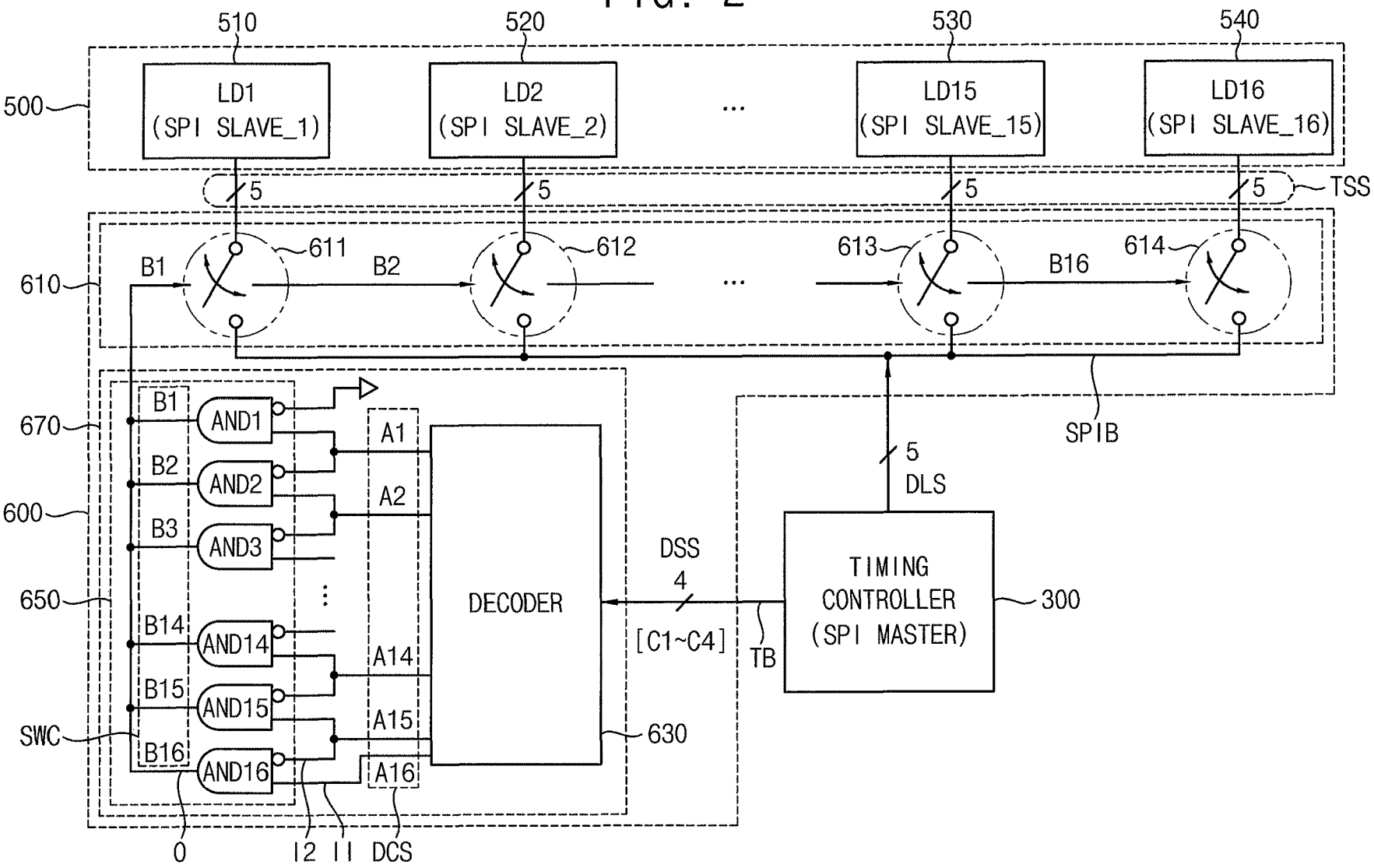
FIG. 2 is a block diagram illustrating a light-source assembly shown in FIG. 1.

FIG. 2 is a block diagram illustrating a light-source assembly shown in FIG. 1. FIG. 3 is a conceptual diagram illustrating input and output signals of a light-source driving controller shown in FIG. 2.

Referring to FIGS. 2 and 3, the light-source assembly includes the light-source driver 500 and the light-source driving controller 600.

The light-source driver 500 includes, for example, 16 LED drivers 510, 520, 530, and 540. The LED drivers 510, 520, 530 and 540 are connected to the timing controller 300 through a serial peripheral interface bus (SPIB).

The serial peripheral interface bus (SPIB) may transmit a plurality of transmission signals TSS. The transmission signals TSS may include a serial clock SCLK outputted from a master, a master output signal MOSI outputted from the master, a master input signal MISO inputted to the master, a slave select signal SS outputted from the master, and a vertical synchronous signal Vsync.

The timing controller 300 may operate as the master, and the 16 LED drivers 510, 520, 530 and 540 may respectively operate as slaves.

The timing controller 300 may select the LED driver to transmit the signal through the slave select signal SS. The timing controller 300 may transmit a signal synchronized with the serial clock SCLK through the master output signal MOSI. The LED driver receives the signal transmitted through the master output signal MOSI of a self slave in synchronization with the serial clock SCLK while the LED driver is activated to receive the signal through the slave select signal SS. The master output signal MOSI synchronized with the serial clock SCLK may be a dimming level signal for driving the LED driver.

The light-source driving controller 600 includes a selector 610 and a signal converter 670.

The selector 610 includes sixteen switches 611, 612, 613, and 614. The sixteen switches 611, 612, 613, and 614 are connected to the sixteen LED drivers 510, 520, 530 and 540 using the serial peripheral interface bus (SPIB).

The signal converter 670 includes a decoder 630 and an operator 650. The 4-bit dimming select signal DSS is converted into a 16-bit switch control signal SWC.

The decoder 630 receives the 4-bit dimming select signal DSS from the timing controller 300.

For example, as shown in FIG. 3, the timing controller 300 generates the 4-bit dimming select signals "0000" to "1111," which respectively correspond to the number of the 16 LED drivers 510, 520, 530, and 540. The timing controller 300 may be sequentially provided with the 4-bit dimming select signals "0000" to "1111" according to an order set in the decoder 630.

The decoder 630 converts the 4-bit dimming select signal DSS into the 16-bit decoded signal DSC. As shown in FIG. 3, the signal is converted into the 16-bit decoded signal A1, A2, . . . , A16 using the 4-bit dimming select signal C1, . . . , C4.

The operator 650 includes sixteen AND-gates AND1, AND2, . . . , AND16 connected to sixteen switches 611, 612, 613, and 614. The sixteen AND-gates AND1, AND2, . . . , AND16 perform a logical multiplication of the 16-bit decoded signal, and output a 16-bit switch control signal SWC, which controls sixteen switches 611, 612, 613 and 614. The 16-bit switch control signal SWC controls the sixteen switches 611, 612, 613 and 614, respectively.

For example, a k-th AND-gate includes a first input terminal 11 for receiving a k-th bit signal of the decoded signal, a second input terminal 12 for receiving an inverting a (k−1)-th bit signal of the decoded signal, and an output terminal O for outputting a k-th control signal to a k-th switch ("k" is a natural number, wherein $1<k\leq16$).

As shown in FIG. 2, the operator 650 includes sixteen AND-gates AND1, AND2, . . . , AND16. The sixteen AND-gates AND1, AND2, . . . , and AND16 receive the 16-bit signals A1, A2, . . . , A16 of the decoding signal DCS, respectively. The sixteen AND-gates AND1, AND2, . . . , AND16 output the 16-bit signals B1, B2, . . . , B16 of the switch control signal SWC to the sixteen switches 611, 612, 613, and 614, respectively.

For example, a first AND-gate AND1 includes a first input terminal for receiving a first bit signal A1 of the decoding signal DCS, a second input terminal for receiving and inverting a ground signal, and an output terminal for outputting a first bit signal B1 to a first switch 611.

A second AND-gate AND2 includes a first input terminal for receiving a second bit signal A2 of the decoding signal DCS, a second input terminal for receiving and inverting the first bit signal A1 of the decoding signal DCS, and an output terminal for outputting a second bit signal B2 to a second switch 612.

As described above, a fifteenth AND-gate AND15 includes a first input terminal for receiving a fifteenth bit signal A15 of the decoding signal DCS, a second input terminal for receiving and inverting the fourteenth bit signal A14 of the decoding signal DCS, and an output terminal for outputting a fifteenth bit signal B15 to a fifteenth switch 613.

A sixteenth AND-gate AND16 that is an ending AND-gate includes a first input terminal 11 for receiving a sixteenth bit signal A16 of the decoding signal DCS, a second input terminal 12 for receiving and inverting the fifteenth bit signal A15 of the decoding signal DCS, and an output terminal O for outputting a sixteenth bit signal B16 to a sixteenth switch 614.

As described above, the timing controller may control a plurality of LED drivers individually using the 4-bit dimming select signal, which is smaller than the number of 16 LED drivers. Therefore, the timing controller may reduce manufacturing costs by controlling 16 LED drivers using only 4 output pins. In addition, by using signal lines connected to 4 output pins, interference noise may be reduced and signal quality may be improved.

Figure 4:
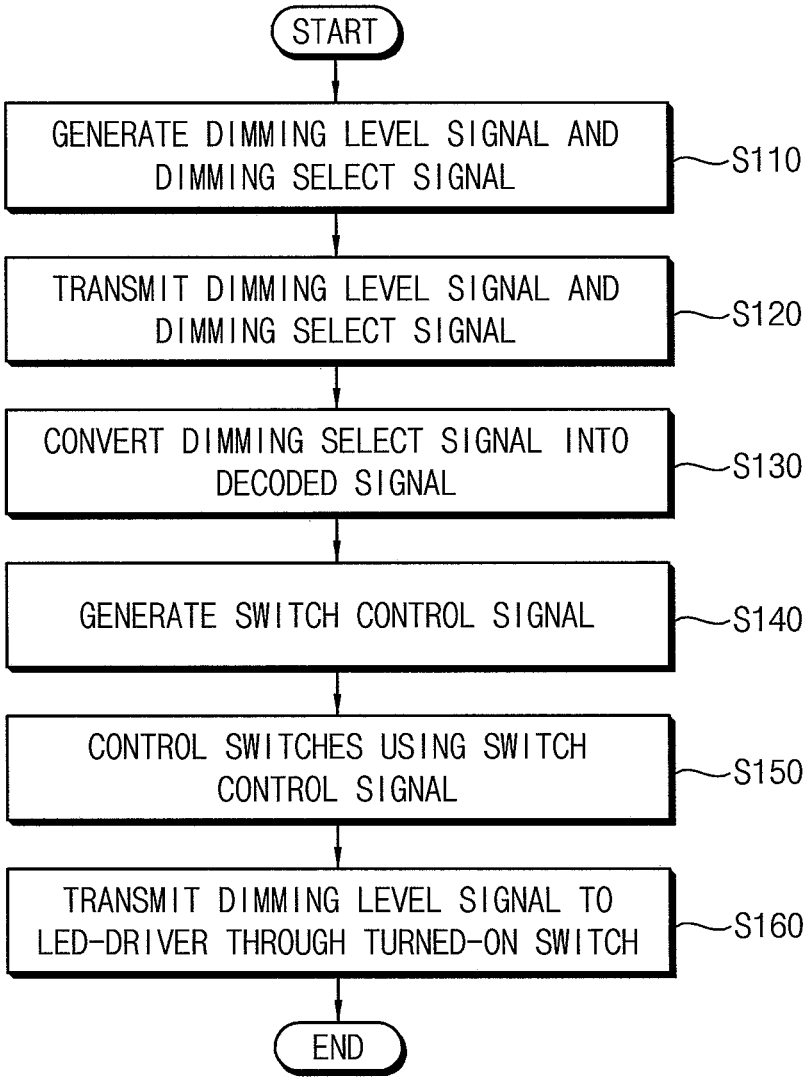
FIG. 4 is a flowchart illustrating a local-dimming method of the display device shown in FIG. 1.

FIG. 4 is a flowchart illustrating a local-dimming method of the display device shown in FIG. 1.

Referring to FIGS. 2, 3 and 4, the timing controller 300 divides the image signal of the frame into a plurality of image blocks DB for the local-dimming mode. The timing controller 300 calculates representative grayscale data of each image block DB. The timing controller 300 generates a plurality of dimming level signals for controlling the luminance of the plurality of light-source blocks LB1, LB2, . . . , LBm using a plurality of representative grayscale data corresponding to the plurality of image blocks DB (operation S110). The plurality of dimming level signals are signals that are applied to a plurality of LED drivers LD1, LD2, . . . , LDm for driving the light-source blocks LB1, LB2, . . . , LBm. The timing controller 300 generates a dimming select signal for selecting the respective LED drivers LD1, LD2, . . . , LDm to which the dimming level signals are applied (operation S110).

For example, when a number of the light-source blocks is 16, the timing controller 300 sequentially generates a 4-bit dimming select signal DSS from "0000" to "1111," or from "1111" to "0000," sequentially (operation S110).

The timing controller 300 sequentially transmits the 4-bit dimming select signal DSS to the decoder 630 through a transmission bus TB connected to 4 output pins corresponding to 4-bits (operation S120).

In addition, the timing controller 300 transmits the dimming level signal DLS of the LED driver, which corresponds to the dimming select signal DSS, to the serial peripheral interface bus (SPIB) (operation S120).

The decoder 630 converts the 4-bit dimming select signal DSS into a 16-bit decoded signal DCS (operation S130). The decoder 630 outputs the 16-bit decoded signal DCS to the operator 650.

The operator 650 performs a logic operation on the 16-bit decoded signal to generate a 16-bit switch control signal SWC (operation S140).

The 16-bit signals of the switch control signal SWC are provided to the sixteen switches 611, 612, 613 and 614 connected to the sixteen LED drivers 510, 520, 530 and 540 as control signals (step S150).

As a result, the dimming select signal DSS transmitted from the timing controller 300 is converted into a switch control signal that turns on only the switch connected to the LED driver corresponding to the dimming select signal DSS through the decoder 630 and the operator 650. Thus, the dimming level signal of the LED driver corresponding to the dimming select signal DSS may be transmitted to the LED driver connected to the turned on switch (operation S160).

For example, when the timing controller 300 transmits the dimming select signal DSS ("0000") to the decoder 630, the decoder 630 converts the dimming select signal DSS to a decoding signal DCS ("0000000000000001"), and outputs the decoding signal DCS ("0000000000000001") to the operator 650. The operator 650 calculates the decoding signal DCS ("0000000000000001") and generates a switch control signal SWC ("0000000000000001"). The first to sixteenth bit signals ("0000000000000001") of the switch control signal SWC are outputted to control terminals of the first through sixteenth switches 611, 612, 613 and 614, respectively. Accordingly, the sixteenth switch 614 is turned on, and the remaining first to fifteenth switches are turned off.

A dimming level signal corresponding to the sixteenth LED driver 540 output from the timing controller 300 is provided to the sixteenth LED driver 540 through the sixteenth switch 614 that is turned on.

In the same manner, when the dimming select signal DSS ("1111") is received from the timing controller 300, the light source driving controller 600 outputs a decoding signal DCS ("1111111111111111") and the operator 650 generates a switch control signal SWC ("1000000000000000") as shown in FIG. 3. Accordingly, the first switch 611 is turned on, and the remaining second to sixteenth switches are turned off.

A dimming level signal corresponding to the first LED driver 510 that is outputted from the timing controller 300 is provided to the first LED driver 510 through the first switch 611 that is turned on.

As described above, the light-source driving controller 600 selects the LED driver corresponding to the dimming level signal among the first to sixteenth LED drivers 510, 520, 530 and 540 using the 4-bit dimming select signal DSS provided from the timing controller 300 to apply a dimming level signal. Thus, the light-source driving controller 600 may perform the local-dimming mode.

Figure 5:
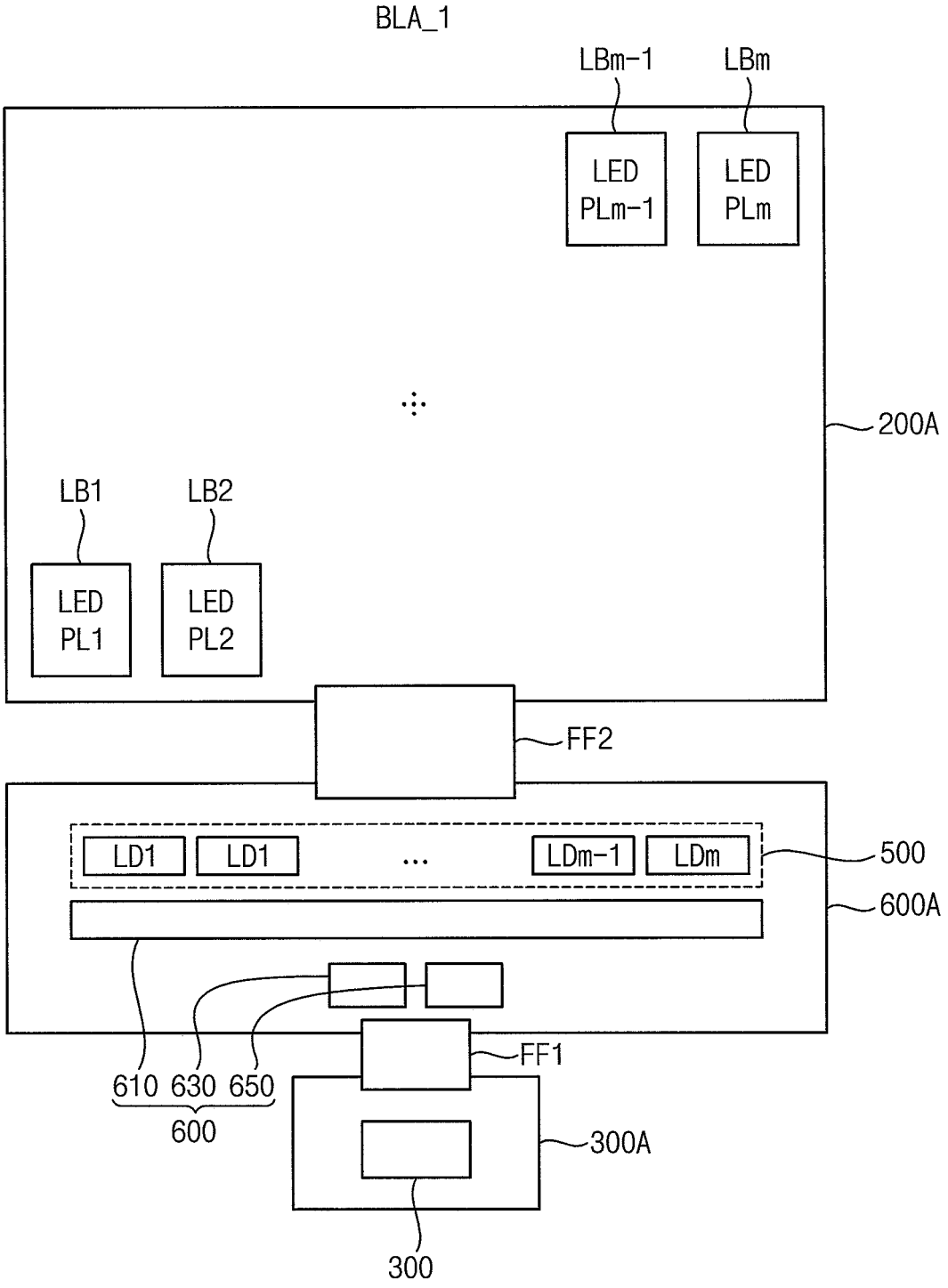
FIG. 5 is a plan view illustrating a light-source assembly device according to one embodiment.

FIG. 5 is a plan view illustrating a light-source assembly device according to one embodiment.

Referring to FIGS. 2 and 5, the light-source assembly BLA_1 of the display device includes a first printed circuit board 200A, a second printed circuit board 300A, a third printed circuit board 600A, a first flexible circuit film FF1, and a second flexible circuit film FF2.

The first printed circuit board 200A includes m light-source blocks LB1, LB2, . . . , LBm-1, and LBm mounted thereon. Them light-source blocks LB1, LB2, . . . , LBm-1, and LBm each include a light-emitting diode plate. For example, the first light-source block LB1 includes a first light-emitting diode plate LED PL1.

A timing controller 300 is mounted on the second printed circuit board 300A.

The third printed circuit board 600A has a light-source driver 500 and a light-source driving controller 600 mounted thereon.

The light-source driver 500 includes m LED drivers LD1, LD2, . . . , LDm-1, LDm that provide a driving signal to each of them light-emitting diode plates LED PL1, LED PL2, . . . , LED PLm-1, LED PLm.

The light-source driving controller 600 includes the selector 610, the decoder 630, and the operator 650 shown in FIG. 2.

The first flexible circuit film FF1 connects the second and third printed circuit boards 300A and 600A to each other.

The second flexible circuit film FF2 connects the first and third printed circuit boards 200A and 600A to each other.

Figure 6:
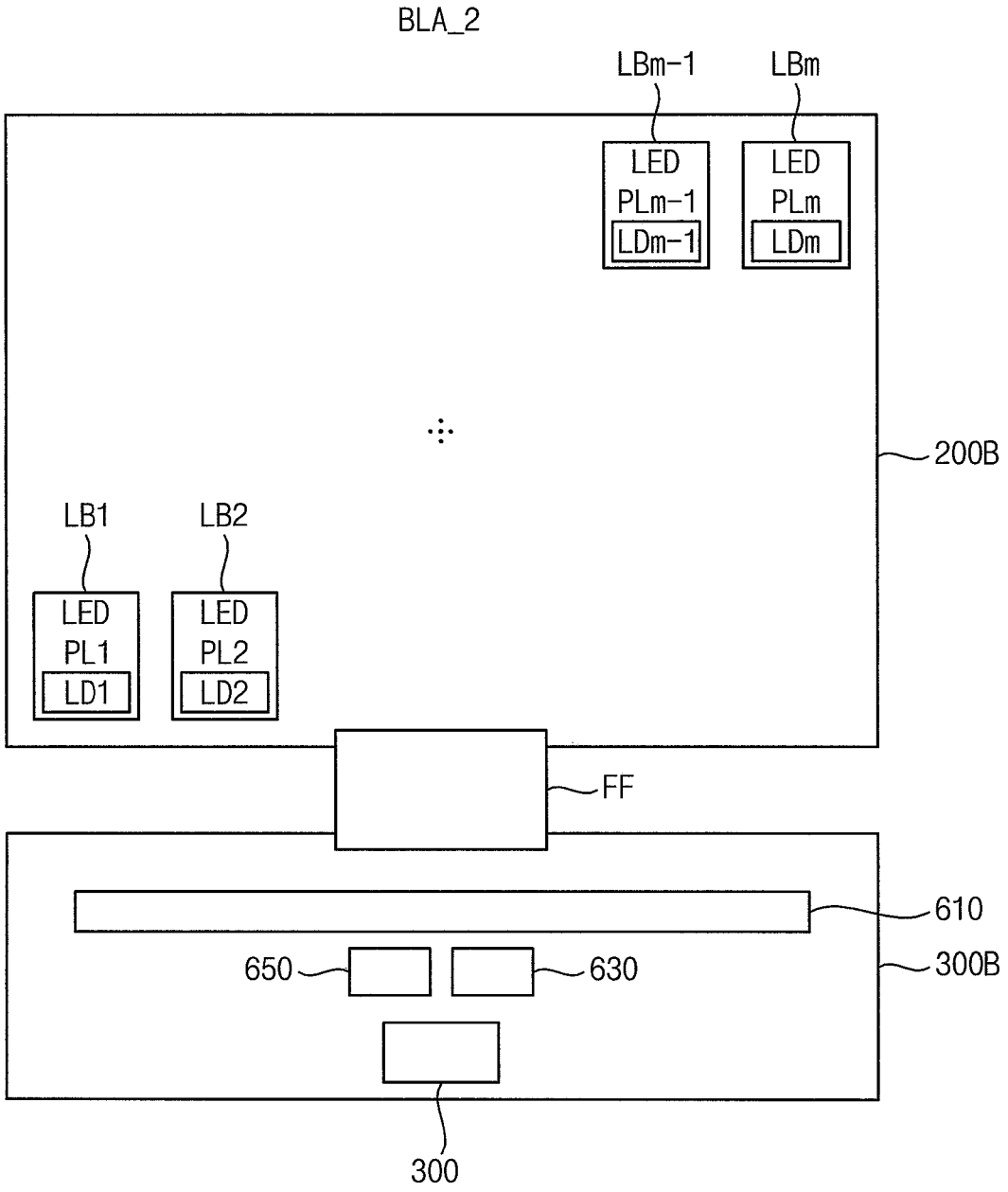
FIG. 6 is a plan view illustrating a light-source assembly device according to one embodiment.

FIG. 6 is a plan view illustrating a light-source assembly device according to one embodiment.

Referring to FIGS. 2 and 6, the light-source assembly BLA_2 includes a first printed circuit board 200B, a second printed circuit board 300B, and a flexible circuit film FF.

The first printed circuit board 200B includes m light-source blocks LB1, LB2, . . . , LBm-1, and LBm that are mounted thereon. Each of the m light-source blocks LB1, LB2, . . . , LBm-1, LBm include a light-emitting diode plate and an LED driver that provides a driving signal to the light-emitting diode plate.

For example, the first light-source block LB1 includes a first light-emitting diode plate LED PL1 and a first LED driver LD1 for providing a driving signal to the first light-emitting diode plate LED PL1.

The second printed circuit board 300B includes a timing controller 300 and a light-source driving controller 600. The light-source driving controller 600 includes the selector 610, the decoder 630, and the operator 650 shown in FIG. 2.

The flexible circuit film FF connects the first printed circuit board 200B and the second printed circuit board 300B to each other.

Hereinafter, the same reference numerals are used to refer to the same or like parts as those described in the previous embodiments, and the same detailed explanations are generally not repeated.

Figure 7:
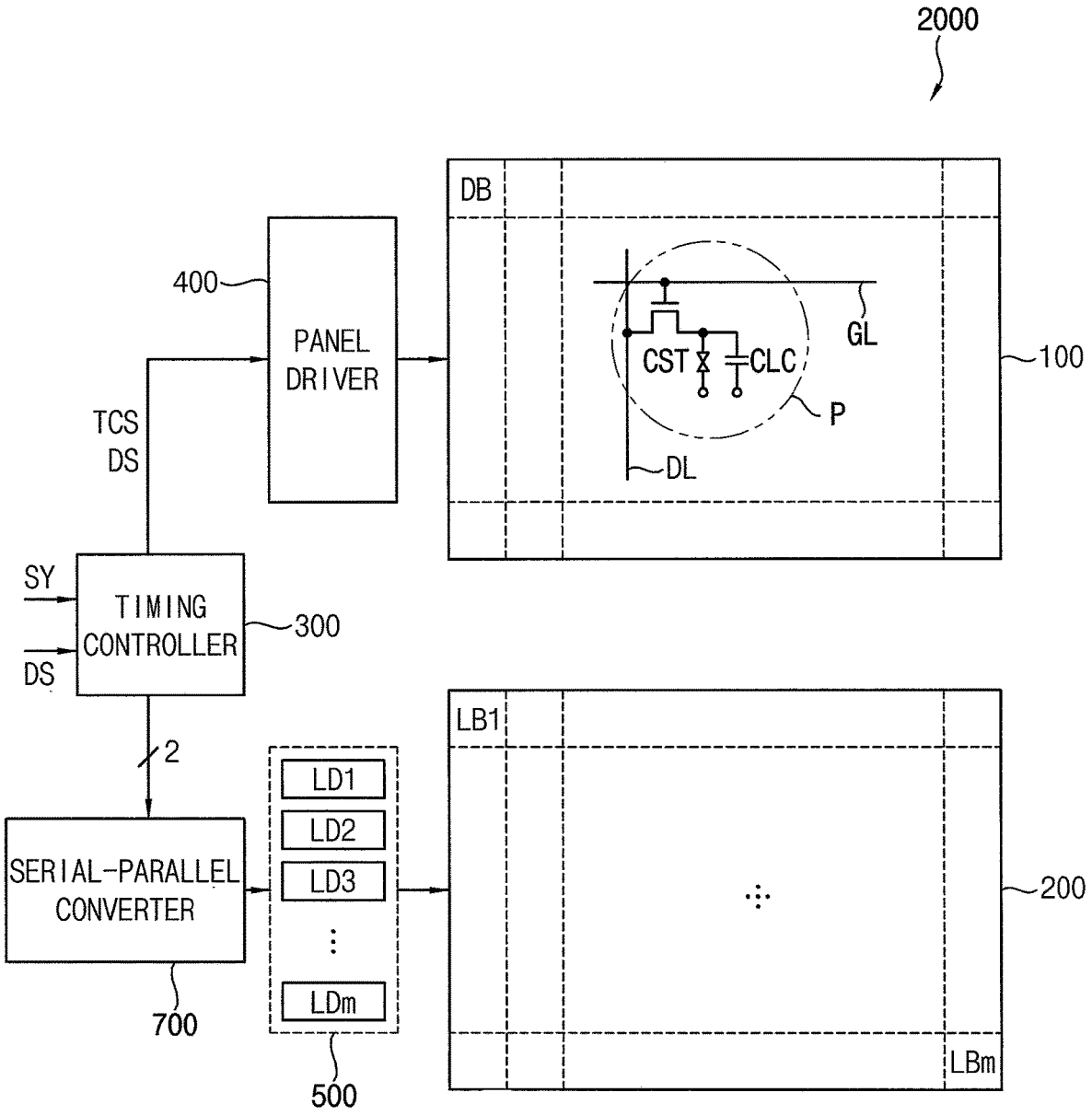
FIG. 7 is a block diagram illustrating a display device according to one embodiment.
Figure 8:
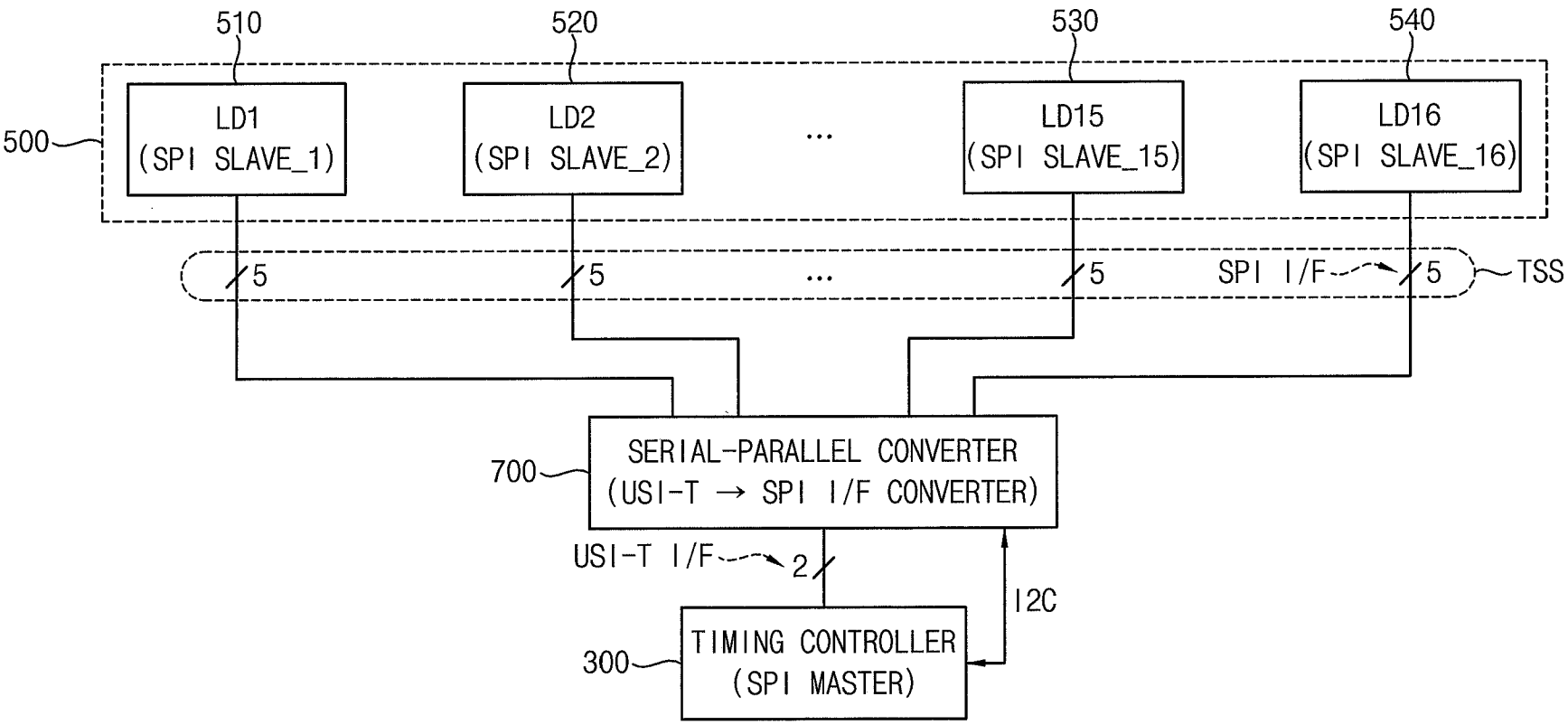
FIG. 8 is a block diagram illustrating a light-source assembly shown in FIG. 7.

FIG. 7 is a block diagram illustrating a display device according to one embodiment. FIG. 8 is a block diagram illustrating a light-source assembly shown in FIG. 7.

Figure 9:
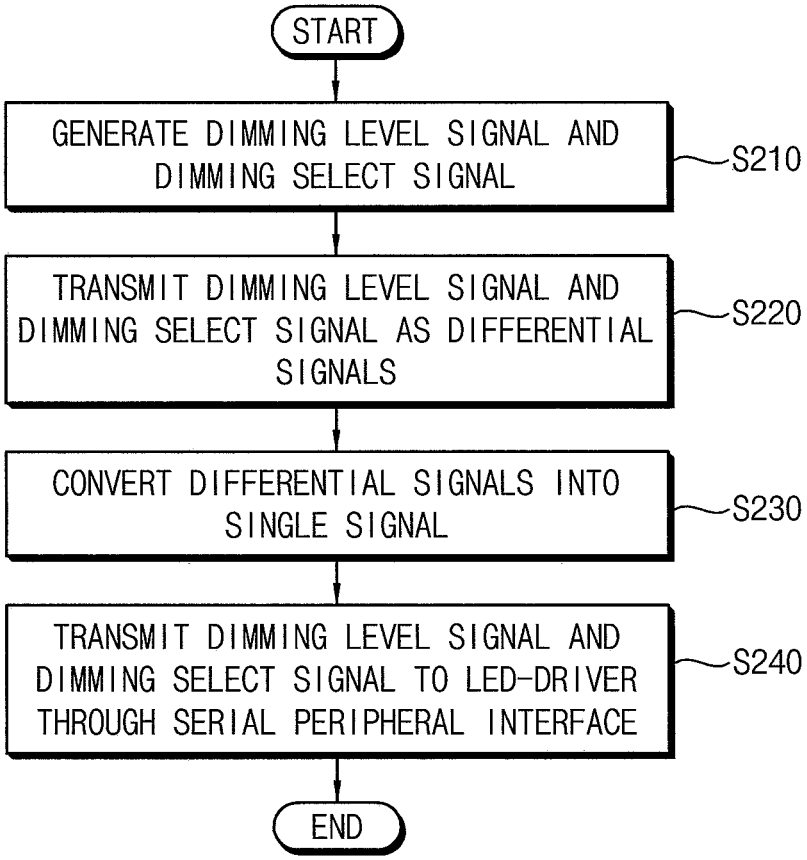
FIG. 9 is a flowchart illustrating a local-dimming method of the display device shown in FIG. 7.

Referring to FIGS. 7, 8, and 9, the display device 2000 includes a display panel 100, a light-source module 200, a timing controller 300, a panel driver 400, and a light-source driver 500, and a serial-to-parallel converter 700.

The timing controller 300 and the serial-to-parallel converter 700 transmit signals using a serial transmission method, for example, a USI-T interface (Unified Standard Interface) (i.e., indicated by USI-T I/F), which is a high-speed, differential-signaling interface. For example, the timing controller 300 and the serial-to-parallel converter 700 may be connected using an inter integrated circuit (I2C) bus (i.e., indicated by I2C).

A signal is transmitted between the serial-to-parallel converter 700 and a plurality of LED drivers 510, 520, 530 and 540 of the light-source driver 500 by a parallel transmission method, for example, a serial peripheral interface (SPI) (i.e., indicated by SPI I/F).

The timing controller 300 may transmit the differential signal serially through two output pins according to the differential signal interface to the serial-to-parallel converter 700. The differential signal may include dimming level signals of the plurality of LED drivers 510, 520, 530 and 540 for performing a local-dimming drive on the light-source blocks LB1, . . . , LBm. The differential signal may include a dimming select signal to select the LED drivers corresponding to the dimming level signals.

The serial-to-parallel converter 700 converts the received differential signal into a single signal. The serial-to-parallel converter 700 converts the single signal into a parallel transmission signal for transmission to the plurality of LED drivers 510 of the light-source driver 500 through the serial peripheral interface.

The serial-to-parallel converter 700 and the plurality of LED drivers 510 transmit a dimming level signal and a dimming select signal using five transmission signals TSS to each other through a serial peripheral interface bus (SPIB). The five transmission signals TSS may include a serial clock SCLK, a master output signal MOSI, a master input signal MISO, a slave select signal SS, and a vertical synchronous signal Vsync.

According to one embodiment, by using the serial-to-parallel converter 700, the signal line between the timing controller 300 and the serial-to-parallel converter 700 may be reduced to simplify circuit implementation. In addition, the serial-to-parallel converter 700 and the plurality of LED drivers 510, 520, 530 and 540 may transmit a dimming level signal and a dimming select signal to each other through a point-to-point serial interface. Thus, the signal quality may be improved.

FIG. 9 is a flowchart illustrating a local-dimming method of the display device shown in FIG. 7.

Referring to FIGS. 8 and 9, the timing controller 300 generates a plurality of dimming level signals for controlling the luminance of the plurality of light-source blocks LB1, LB2, . . . , LBm based on an image signal of the frame (operation S210). The plurality of dimming level signals are signals that are applied to a plurality of LED drivers LD1, LD2, . . . , LDm for driving the light-source blocks LB1, LB2, . . . , LBm. The timing controller 300 generates a dimming select signal for selecting the plurality of LED drivers to which the plurality of dimming level signals is applied (operation S210).

The timing controller 300 serially transmits the dimming level signal and the dimming select signal to the serial-to-parallel converter 700 as differential signals through a differential signal interface (operation S220).

The serial-to-parallel converter 700 converts received differential signals into a single signal. The serial-to-parallel converter 700 converts the single signal into a parallel transmission signal for transmission to the plurality of LED drivers 510 through the serial peripheral interface (operation S230).

The serial-to-parallel converter 700 and the plurality of LED drivers 510 transmit a dimming level signal and a dimming select signal using five transmission signals TSS to each other through a serial peripheral interface bus (SPIB). The five transmission signals TSS may include a serial clock SCLK, a master output signal MOSI, a master input signal MISO, a slave select signal SS, and a vertical synchronous signal Vsync (operation S240).

According to one embodiment, by using the serial-to-parallel converter 700, the signal line between the timing controller 300 and the serial-to-parallel converter 700 may be reduced to simplify circuit implementation. In addition, the serial-to-parallel converter 700 and the plurality of LED drivers 510, 520, 530 and 540 may transmit a dimming level signal and a dimming select signal to each other through a point-to-point serial interface. Thus, the signal quality may be improved.

According to embodiments, in the local-dimming mode, the manufacturing cost may be reduced and the signal quality may be improved by reducing the number of control signal pins between the timing controller and the plurality of LED drivers.

The present disclosure may be applied to a display device and an electronic device having the display device. For example, the present disclosure may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of the present disclosure and is not to be construed as limiting thereof. Although a few embodiments of the present disclosure have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific embodiments disclosed, and that modifications to the disclosed embodiments, as well as other embodiments, are intended to be included within the scope of the appended claims. The present disclosure is defined by the following claims, with functional equivalents of the claims to be included therein.

What is claimed is:

1. A display device comprising:

a light-source module comprising a plurality of light-source blocks configured to provide light to a display panel;

a plurality of light-source drivers configured to drive the plurality of light-source blocks;

a timing controller configured to generate a dimming level signal of a corresponding one of the light-source blocks based on an image signal for implementing a frame, and to generate a n-bit dimming select signal for selecting a corresponding one of the light-source drivers corresponding to the dimming level signal, the n-bit dimming select signal being different from the image signal;

a signal converter configured to convert the n-bit dimming select signal into an m-bit switch control signal, "n" and "m" being natural numbers, "m" corresponding to a number of outputs from the signal converter, and n being less than m; and a plurality of switches connected between the timing controller and the plurality of light-source drivers, and configured to provide a plurality of dimming level signals to the plurality of light-source drivers based on the m-bit switch control signal, wherein the signal converter comprises:

a decoder configured to convert the n-bit dimming select signal into an m-bit decoded signal; and an operator configured to receive the m-bit decoded signal, to perform a logical operation on the m-bit decoded signal, and to generate the m-bit switch control signal.

2. The display device of claim 1, wherein the m-bit decoded signal of the switch control signal is applied to a control terminal of each of the plurality of switches.

3. The display device of claim 1, wherein the operator comprises a plurality of AND-gates respectively connected to the plurality of switches, and wherein a k-th AND-gate among the plurality of AND-gates comprises a first input terminal for receiving a k-th bit signal of the m-bit decoded signal, a second input terminal for receiving and inverting a (k-1)-th bit signal of the m-bit decoded signal, and an output terminal connected to a control terminal of a k-th switch among the plurality of switches, "k" being a natural number.

4. The display device of claim 3, wherein a second input terminal of a first AND-gate among the plurality of AND-gates is configured to receive and invert a ground signal.

5. The display device of claim 1, wherein the timing controller is configured to transmit the plurality of dimming level signals to the plurality of light-source drivers through a serial peripheral interface.

6. The display device of claim 1, further comprising:

a first printed circuit board on which the light-source blocks are mounted;

a second printed circuit board on which the timing controller is mounted; and a third printed circuit board on which the plurality of switches, the decoder, and the operator are mounted.

7. The display device of claim 1, further comprising:

a first printed circuit board on which the light-source blocks are mounted; and a second printed circuit board on which the timing controller, the plurality of switches, the decoder, and the operator are mounted.

8. A method of driving a display device comprising a light-source module comprising a plurality of light-source blocks configured to provide light to a display panel, and a plurality of light-source drivers configured to drive the plurality of light-source blocks, the method comprising:

generating a dimming level signal of a corresponding one of the light-source blocks based on an image signal for implementing a frame;

outputting a n-bit dimming select signal for selecting one of the light-source drivers corresponding to the dimming level signal, and outputting the dimming level signal of a corresponding one of the light-source blocks, the n-bit dimming select signal being different from the image signal;

converting, using a signal converter, the n-bit dimming select signal into an m-bit switch control signal, "n" and "m" being natural numbers, "m" corresponding to a number of outputs from the signal converter, and n being less than m;

applying the m-bit switch control signal to a plurality of switches connected to the plurality of light-source drivers; and applying a plurality of dimming level signals to corresponding ones of the plurality of light-source drivers based on a driving of the plurality of switches, wherein converting the n-bit dimming select signal comprises:

converting the n-bit dimming select signal into an m-bit decoded signal; and generating the m-bit switch control signal by receiving the m-bit decoded signal and performing an AND-operation on the m-bit decoded signal.

9. The method of claim 8, further comprising:

performing the AND-operation on a k-th bit signal of the m-bit decoded signal, and an inverted signal of which a (k-1)-th bit signal of the m-bit decoded signal is inverted;

generating a k-th bit signal of the m-bit switch control signal; and applying the k-th bit signal of the m-bit switch control signal to a control terminal of a k-th switch, "k" being a natural number, and k being greater than 1, and less than or equal to m).

10. The method of claim 9, further comprising: generating a first bit signal of the m-bit switch control signal applied to a control terminal of a first switch by performing an AND-operation on the first bit signal and an inverted signal of a ground signal.

11. The method of claim 8, further comprising transmitting the dimming level signal to the corresponding one of the light-source drivers through a serial peripheral interface.

12. A display device comprising:

a light-source module comprising a plurality of light-source blocks configured to provide light to a display panel;

a plurality of light-source drivers configured to drive the plurality of light-source blocks;

a timing controller configured to transmit a dimming level signal of a corresponding one of the light-source blocks, which is generated based on an image signal for implementing a frame, and to transmit a dimming select signal comprising digital data for identifying and selecting a corresponding one of the light-source drivers to which the dimming level signal is applied, as a serial signal, the dimming select signal being different from the image signal; and a serial-to-parallel converter configured to receive the dimming level signal and the dimming select signal from the timing controller, and to convert the dimming level signal and the dimming select signal transmitted in a serial signal into a parallel signal, and to transmit the parallel signal to the plurality of light-source drivers in parallel.

13. The display device of claim 12, wherein the timing controller is configured to transmit the dimming level signal and the dimming select signal to the serial-to-parallel converter as differential signals.

14. The display device of claim 13, wherein the serial-to-parallel converter is configured to convert the differential signals into a plurality of single signals, and to transmit the plurality of single signals to the plurality of light-source drivers.

15. The display device of claim 12, wherein the timing controller is configured to transmit signals to the serial-to-parallel converter through a high-speed differential signaling interface, and the serial-to-parallel converter is configured to transmit signals to the plurality of light-source drivers through a serial peripheral interface.

16. A method of driving a display device comprising a light-source module comprising a plurality of light-source blocks configured to provide light to a display panel, and a plurality of light-source drivers configured to drive the plurality of light-source blocks, the method comprising:

generating a dimming level signal of the light-source block, based on an image signal for implementing a frame, and a dimming select signal comprising digital data for identifying and selecting a light-source driver to which the dimming level signal is applied, the dimming select signal being different from the image signal;

transmitting the dimming level signal and the dimming select signal as a serial signal; and receiving the dimming level signal and the dimming select signal transmitted in the serial signal, and transmitting the dimming level signal and the dimming select signal to the plurality of light-source drivers in parallel.

17. The method of claim 16, further comprising: transmitting the dimming level signal and the dimming select signal as differential signals through a differential signal interface.

18. The method of claim 17, further comprising:

converting the differential signals into a plurality of single signals; and transmitting the plurality of single signals to the plurality of light-source drivers through a serial peripheral interface.

* * * * *